United States Patent [19]

Kellogg

[11] 3,937,131

[45] Feb. 10, 1976

[54] CARTON FEEDING APPARATUS

[75] Inventor: Robert C. Kellogg, Milford, Mich.

[73] Assignee: Ex-Cell-O Corporation, Troy, Mich.

[22] Filed: July 19, 1974

[21] Appl. No.: 489,880

[52] U.S. Cl. ..... 93/53 SD; 93/44.1 R; 93/53 BF; 93/53 R

[51] Int. Cl.[2] ..... B31B 1/76

[58] Field of Search ..... 93/53 R, 53 BF, 53 AC, 93/53 SD, 53 M, 49 R, 44.1 R, 36 R

[56] References Cited

UNITED STATES PATENTS

| | | | |
|---|---|---|---|
| 2,747,473 | 5/1956 | Monroe et al. | 93/53 R |
| 2,765,715 | 10/1956 | Kerr | 93/53 R |
| 2,936,681 | 5/1960 | Earp | 93/53 BF |
| 3,315,575 | 4/1967 | Pinto | 93/53 BF |
| 3,599,541 | 8/1971 | Allen | 93/53 R |
| 3,633,470 | 1/1972 | Bingham | 93/53 R |
| 3,783,752 | 1/1974 | Langen et al. | 93/53 SD |

*Primary Examiner*—James F. Coan
*Attorney, Agent, or Firm*—Reising, Ethington, Barnard, Perry & Brooks

[57] ABSTRACT

Carton feeding and erecting apparatus for transferring flattened cartons from one location to another while simultaneously unfolding the cartons to an erect, or partially erect, condition. The apparatus is particularly useful in high speed packaging operations such as operations wherein thermoplastic coated paperboard cartons are to be sequentially unfolded or erected from a flattened condition, closed and sealed at their bottom ends, filled with milk or other contents, and closed and sealed at their top ends. The apparatus includes a carton receiving station at one location, a carton delivery station at another location, carton carrying means operable to engage a flattened carton at the receiving station and carry the carton to the delivery station, and carton unfolding means operatively associated with the carrying means and operable to unfold a carton to its erect condition as the carton is carried by the carrying means from the receiving station to the delivery station.

32 Claims, 12 Drawing Figures

CARTON FEEDING APPARATUS

BACKGROUND OF THE INVENTION

1. Field of The Invention

This invention relates generally to packaging apparatus, and is particularly concerned with carton feeding and erecting apparatus for transferring flattened cartons from one location to another while simultaneously unfolding the cartons to an erect condition. The feeding and erecting operation of the apparatus of this invention may precede the transfer of the erect carton to a packaging machine wherein the erect carton is sequentially closed and sealed at one end, filled with milk or other contents, and closed and sealed at the other end by apparatus of the type disclosed, for example, in U.S. Pat. Nos. 3,002,328 and 3,303,761.

DESCRIPTION OF THE PRIOR ART

One prior art apparatus of this general type is disclosed in U.S. Pat. No. 3,307,325 wherein flattened, tubular carton blanks are removed from a carton holder by reciprocating suction cups which move toward and away from the carton blank holder and successively grip the surface of the folded carton blanks. When the suction cup is retracted, it cooperates with a deflecting plate to unfold the carton to a rectangular configuration, the carton then being placed onto other apparatus for end closing, filling and sealing operations.

SUMMARY OF THE INVENTION

The present invention is embodied in apparatus including carton carrying means operable to engage a flattened carton at a receiving station at one location and carry the carton to a delivery station at another location with carton unfolding means operatively associated with the carrying means in such a manner that the carton is unfolded to its erect condition as it is carried by the carrying means from the receiving station to the delivery station. In the disclosed embodiment, the carrying means is in the form of suction cups mounted on a rotating drum so that the suction cups cyclically move past the receiving and delivery station.

The carton unfolding means includes stationary and movable elements engageable with portions of the carton carried by the carrying means to cause unfolding movement of the carton as it travels from the receiving station to the delivery station. The suction cup carrying means is mounted on the drum in such a manner that it reciprocates in a direction transverse to the axis of rotation of the drum during rotation of the drum to carry out the unfolding or carton erecting operation.

Another aspect of the invention includes clamping means carried by the drum for engaging a carton at the receiving station and holding it in a position to be engaged by the suction cup carrying means, the clamping means being operable during rotation of the drum to move out of engagement with the carton engaged by the carrying means to a retracted position as the carton moves from the receiving station to the delivery station.

A further aspect of the invention includes a supply container or magazine for containing a plurality of flattened cartons, with unloading means for transferring cartons one at a time from the storage container to the receiving station to be sequentially engaged by the clamping means and carton carrying means. Carton orienting means is also provided at the receiving station for momentarily positioning cartons fed to the receiving station to be engaged by the clamping means. The various components may be interconnected by a drive train to assure operation of the components in timed sequence with each other.

The invention is thus not only embodied in the overall combination of components for carrying out their respective functions, but in the individual components per se.

Figure 4:
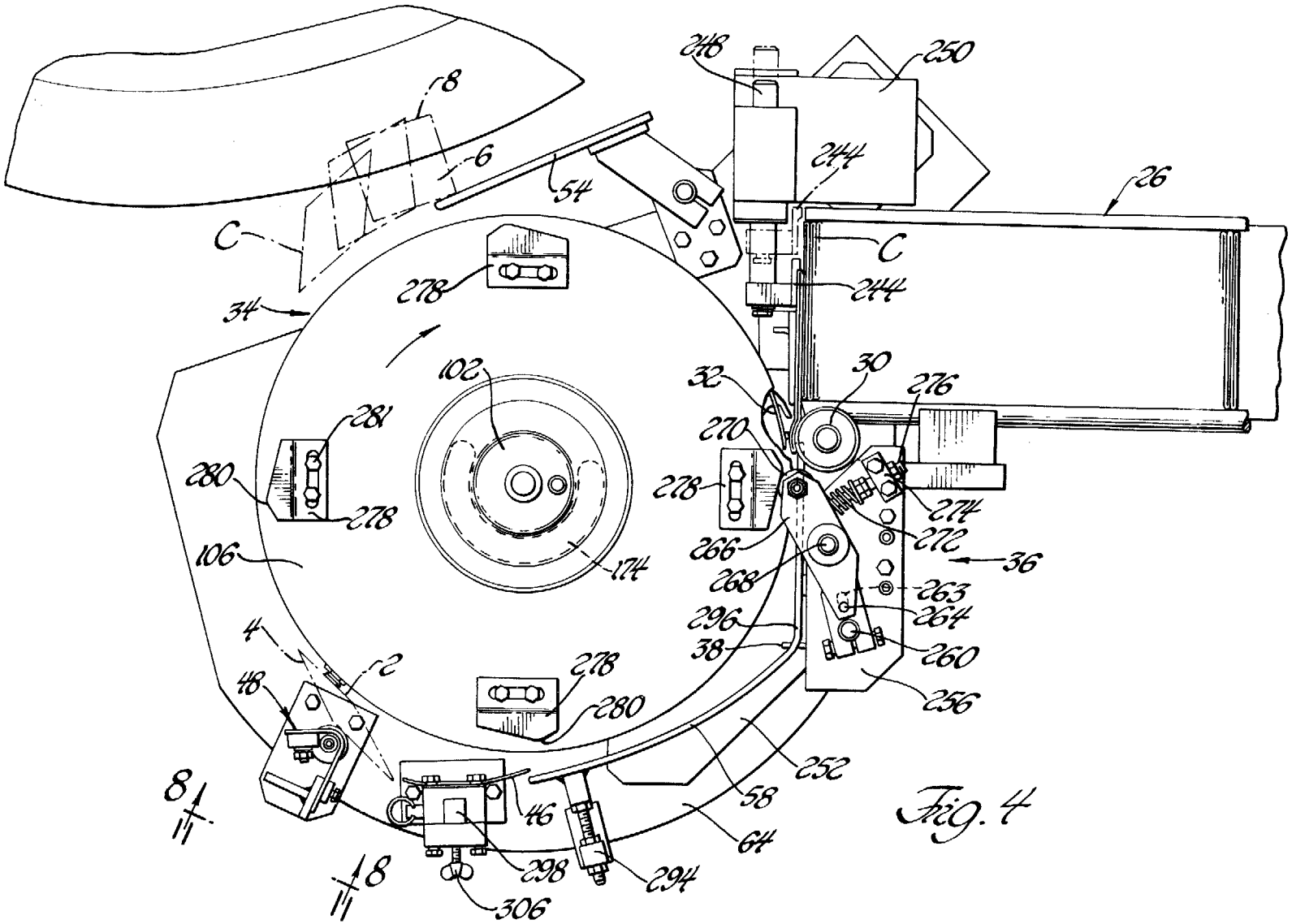
FIG. 4 is a top plan view of apparatus embodying the present invention.
Figure 5:
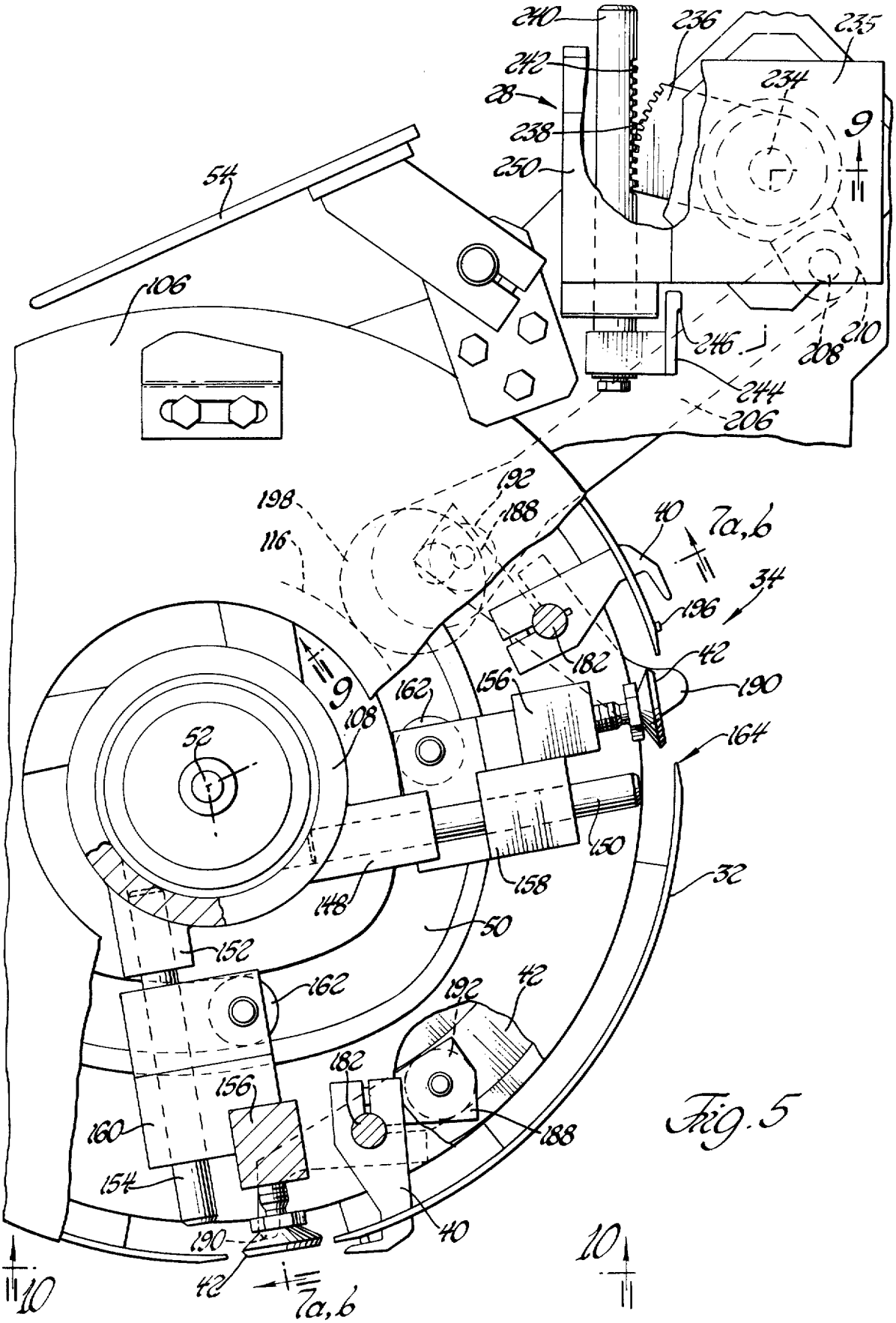
FIG. 5 is an enlarged, fragmentary top plan view, similar to FIG. 2, with portions of the apparatus removed to disclose some of the internal parts of the apparatus.
Figure 6:
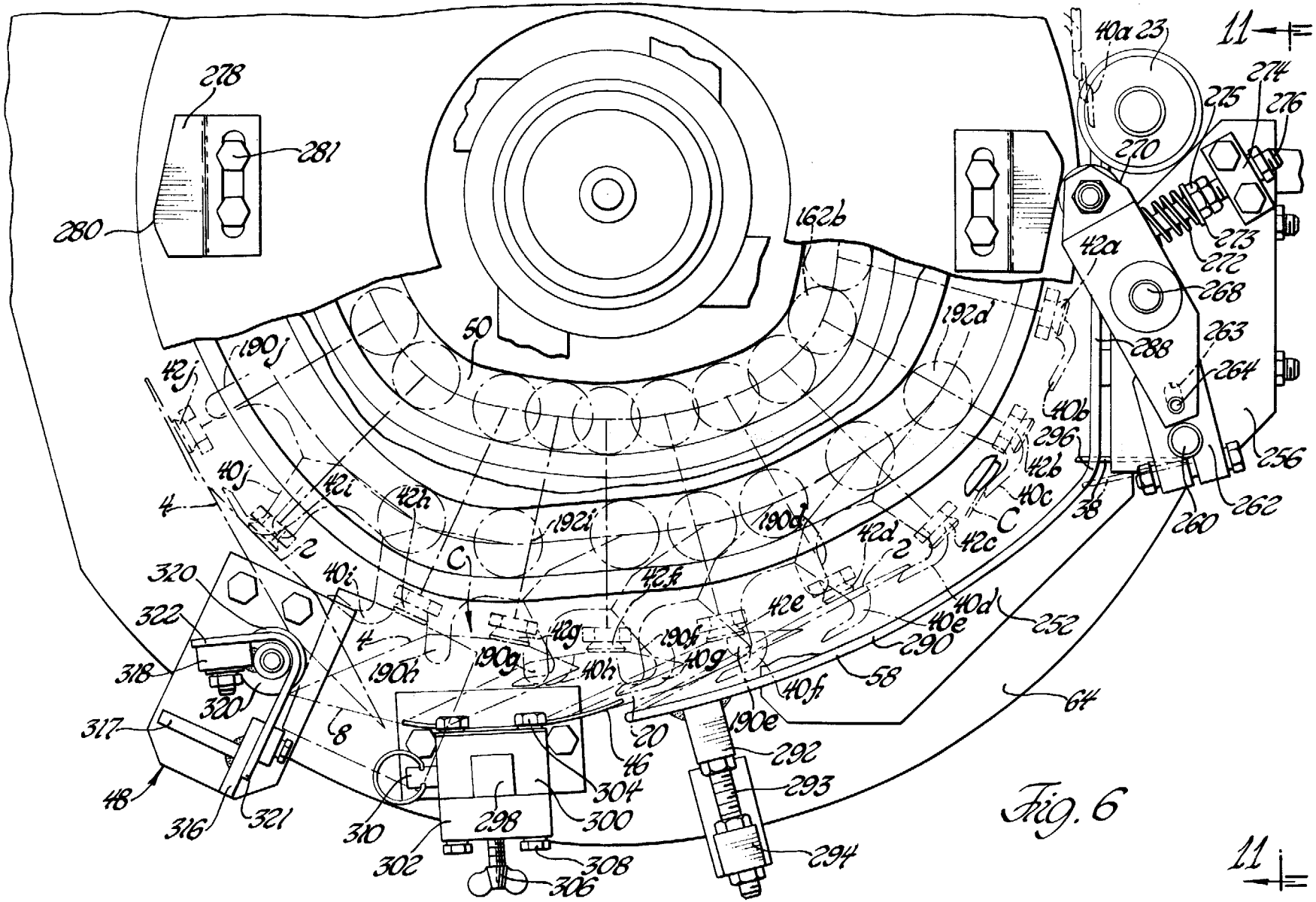
FIG. 6 is an enlarged view similar to FIG. 5 illustrating still additional internal parts of the apparatus and illustrating the parts in different positions as a carton is fed from one location to another while being simultaneously unfolded from the flattened condition illustrated in FIGS. 1 and 2.
Figure 8:
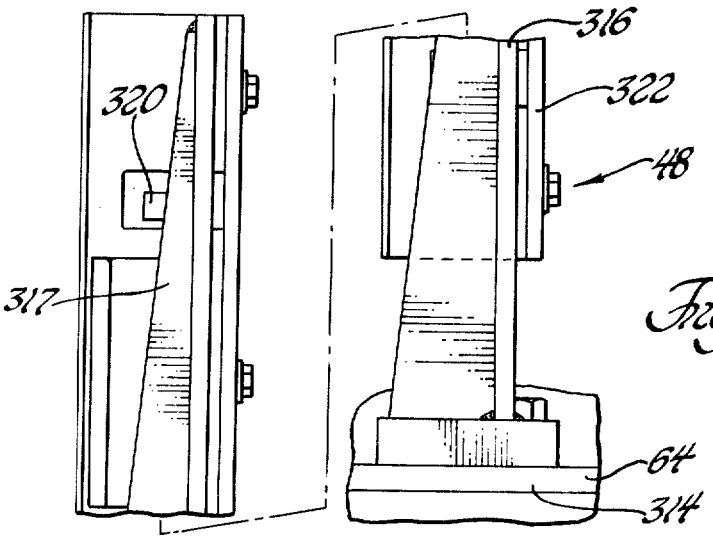
Figure 9:
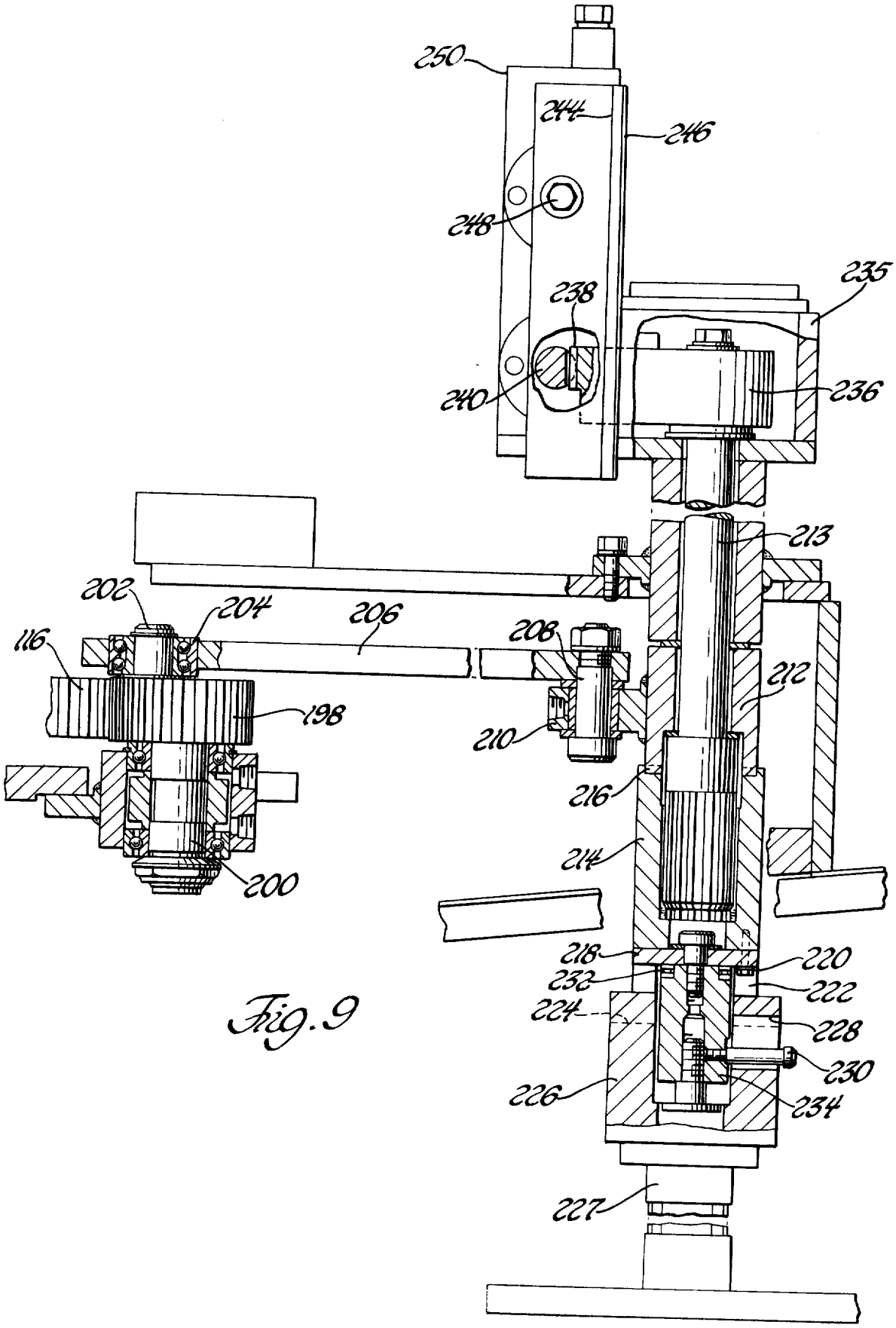
Figure 10:
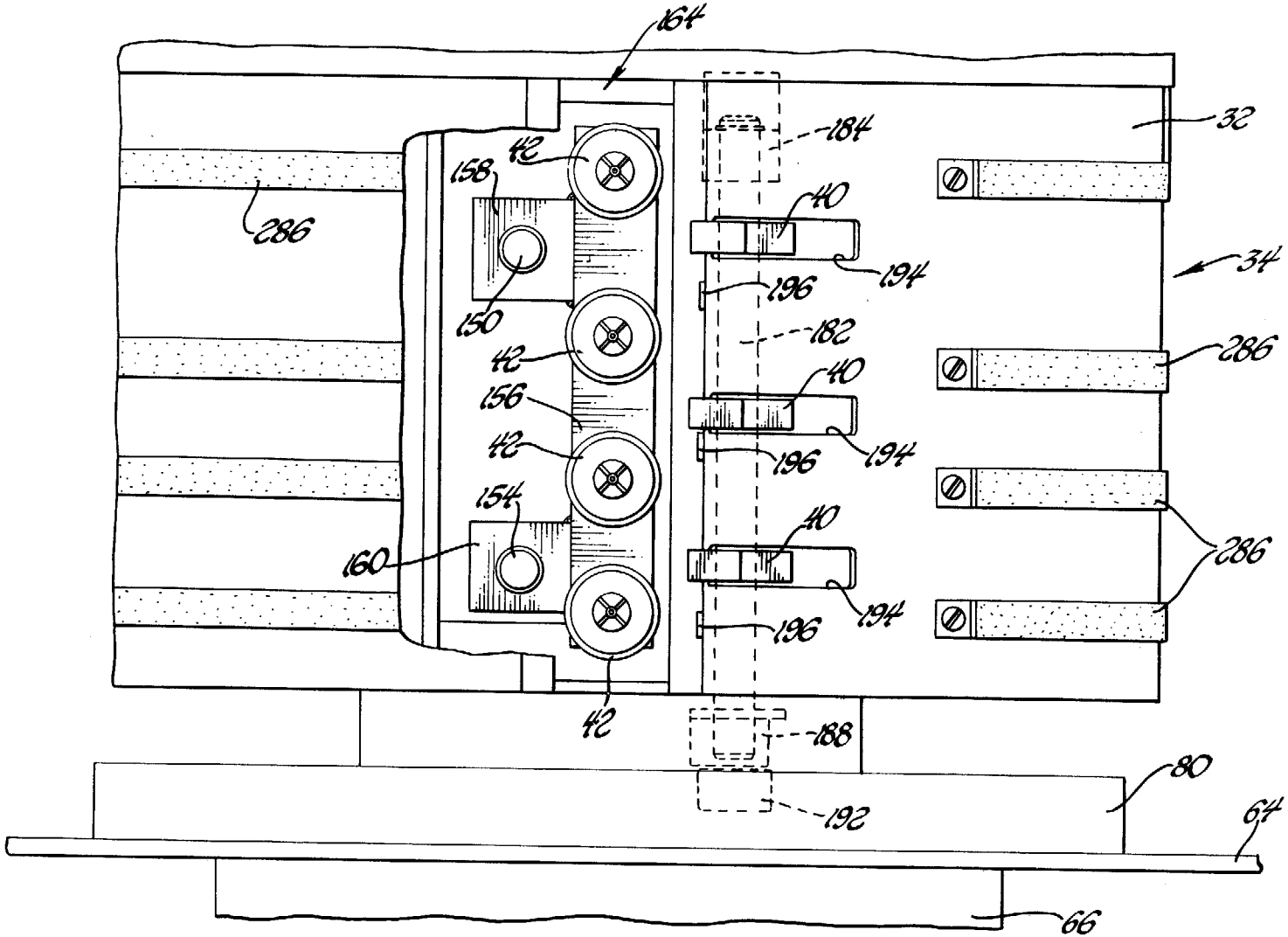
Figure 11:
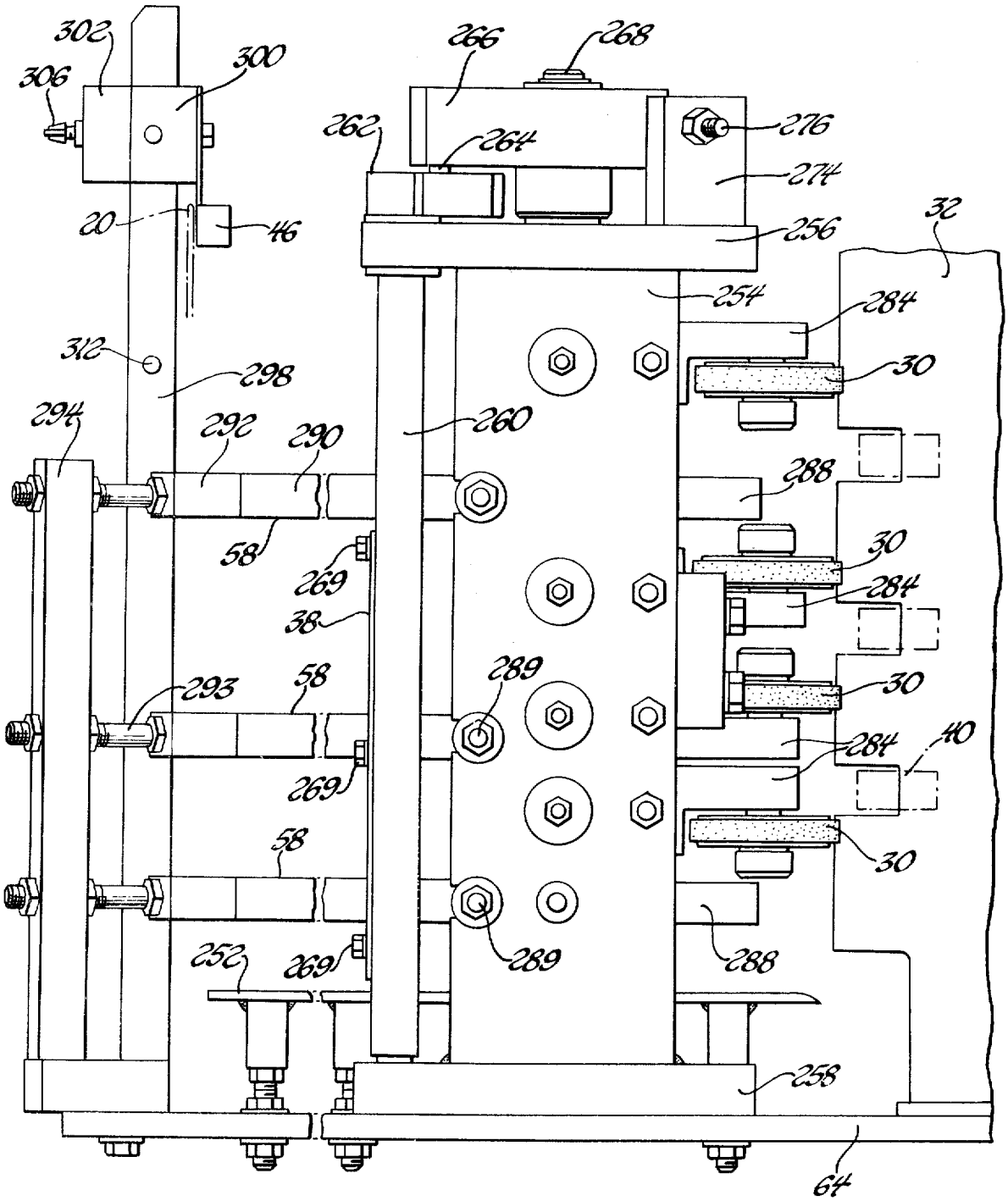

FIGS. *7a* and *7b* are sectional views of the upper and lower portions, respectively, of the apparatus taken on lines *7ab–7ab* of FIG. 5;

FIG. 8 is an elevational view of a stationary unfolding member of the apparatus of FIG. 4 as viewed approximately along lines 8—8 of FIG. 4;

FIG. 9 is a sectional view of the carton unloading means taken on lines 9—9 of FIG. 5;

FIG. 10 is a partial elevational view of the apparatus as viewed along lines 10—10 of FIG. 5 with a portion of the outer wall broken away; and FIG. 11 is an elevational view of a portion of the apparatus as viewed approximately along lines 11—11 of FIG. 6.

Figure 1:
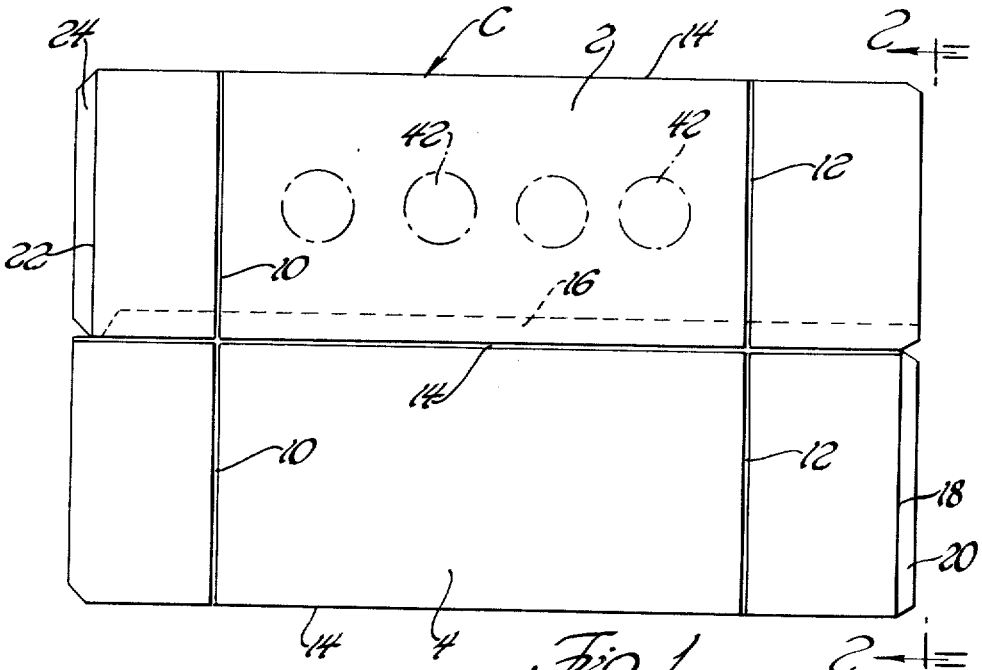
FIG. 1 is a plan view of a flattened, tubular carton blank of the general type with which the present invention is used.
Figure 2:
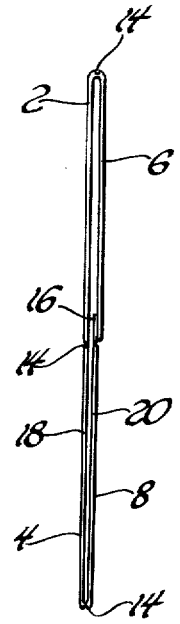
FIG. 2 is an end view of the carton of FIG. 1 as viewed along lines 2—2 of FIG. 1.

With reference first to FIGS. 1 and 2, reference character C collectively designates a carton which is in flattened, tubular form. The carton C of FIG. 1 is preferably made up of paperboard provided with a thermoplastic coating, such as polyethylene, on both sides. However, the present invention is, of course, not limited to any specific configuration or material of the carton.

The carton C of FIG. 1 includes side panels 2, 4, 6 and 8. The side panels 2, 4, 6 and 8 are separated from end closure panels by transverse score lines 10 and 12, and are separated from each other by longitudinal scored lines 14. Additional scored lines (not shown) may be provided on the end closure panels depending on the particular configuration desired for the end closures. The end closure panels may be scored, for example, in the same manner as the cartons shown in U.S. Pat. No. 3,002,328.

A side seam flap 16 projects from the scored line 14 of the side panel 8 and is adhesively secured to the inner surface of the side panel 6 as shown in FIG. 2 to form the carton into tubular configuration. The end closure portion of the side panel 4 to the right of the score line 12, as viewed in FIG. 1, has an end edge 18, and a portion 20 of the side panel 8 projects beyond the end edge 18 of the side panel 4. Similarly, the end closure portion of the side panel 2 to the left of the scored line 10 as viewed in FIG. 1 has an end edge 22, and a portion 24 of the side panel 6 projects beyond the end edge 22.

Figure 3:
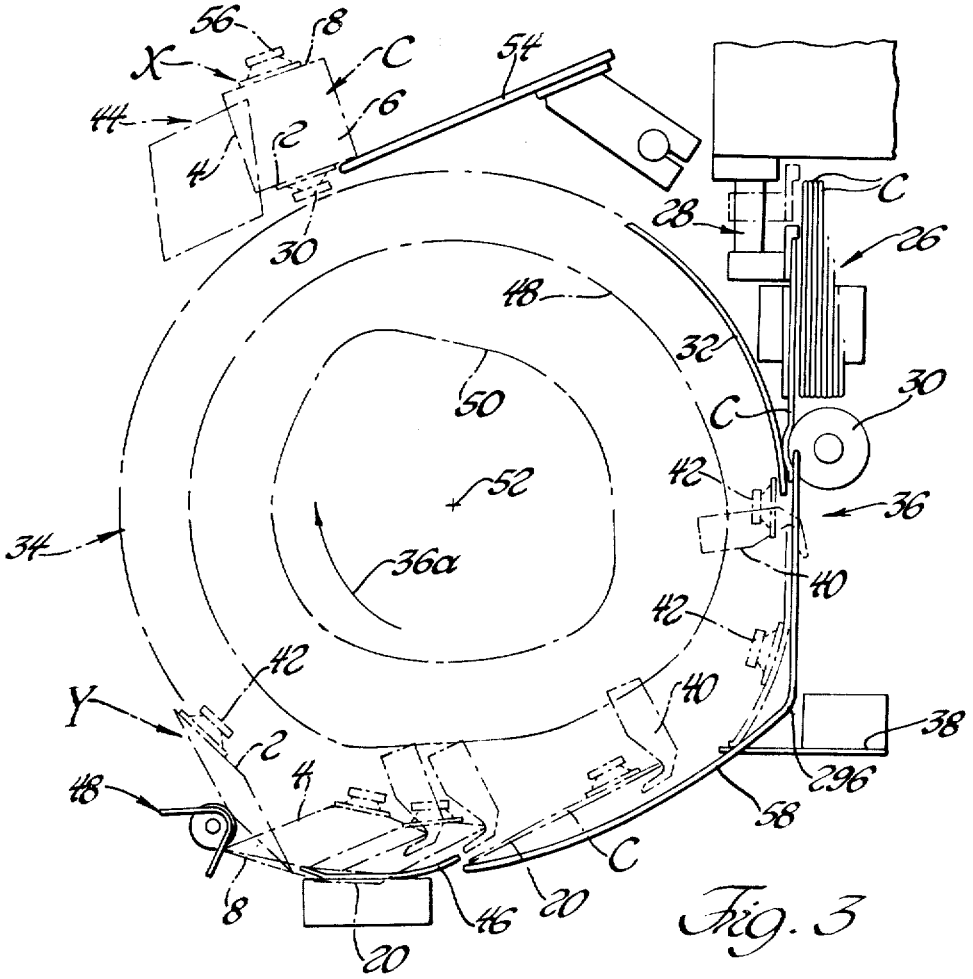
FIG. 3 is a schematic illustration of apparatus embodying the invention illustrating in part the sequence of operations performed on the cartons as they are fed from one location to another by the apparatus.

In accordance with the present invention, the cartons C are unfolded from the flattened condition illustrated in FIGS. 1 and 2 to an erect, tubular configuration of rectangular cross-section illustrated in phantom lines at position X in FIG. 3 as they are transferred by the apparatus of this invention from one location to another.

FIG. 3 schematically illustrates the operation of the apparatus. In FIG. 3, reference numeral 26 designates a supply container or magazine for containing a quantity of the flattened cartons C with the cartons positioned such that the end portion 20 is upright and located to the right, as viewed in FIG. 3, of the carton side panels 2 and 4. The flattened cartons are transferred one at a time by unloading means 28 to carton driving means defined by friction wheels 30 and the side wall 32 of a rotating drum 34. The drum or turret rotates in a clockwise direction as indicated by arrow 36*a* in FIG. 3.

The carton is propelled by the engagement between the drum and friction wheel 30 onto a carton receiving station indicated generally by reference numeral 36 where its leading edge engages a stop plate or orienting member 38 momentarily. The trailing end of the carton is then engaged by clamping hooks 40 which move to a clamping position to hold the carton C to be engaged by carton carrying means in the form of suction cups 42. The suction cups 42 carry the carton C from the carton receiving station 36 to a carton delivery station illustrated generally by reference numeral 44. During the travel of the carton from the receiving station 36 to the delivery station 44, the carton engages stationary carton unfolding members 46 and 48 which, in cooperation with the movement of the clamping members 40 and suction cup carrying members 42, cause the carton to unfold to the configuration illustrated at position X at the delivery station 44.

During the rotation of the drum, the clamping hooks 40 move from clamping to retracted positions to assist in the unfolding operation of the cartons, which movement of the hooks 40 is controlled by the engagement of the hooks with a cam track 49. Similarly, the carton carrying suction cup members 42 reciprocate in a direction transverse to the axis of rotation 52 of the drum, the reciprocation and path of movement of the suction cups 42 being controlled by a suction cup cam track 50.

As is pointed out in greater detail below, the portion 20 of the side panel 8 of the carton engages the outer surface of the carton unfolding member 46 which, in cooperation with the movement of the suction cups carrying means 42 causes unfolding movement of the flattened carton. When the carton passes the stationary member 46, the leading corner at the junction of panels 4 and 8 of the carton engage a stationary abutment member 48 which causes the carton to unfold, and move to an "overcenter" position creating a back break condition as illustrated in position Y in FIG. 3 until the suction cups 42 carry the carton past the stationary unfolding member 48. When the carton is stripped past the stationary abutment 48, it springs back to the substantially rectangular configuration shown at position X at the delivery station 44. At the delivery station 44, the carton engages a transfer guide member 54 and is picked up by a carton pickup means which may be in the form of a suction cup 56 to carry the erected carton to machinery for performing end closing, filling and sealing operations. During its travel from the carton receiving station 36 to the stationary unfolding member 46, the carton engages stationary guide bars 58. As illustrated in FIGS. 1, 2 and 3, the carton side panels 6 and 8 engage the stationary guide bars 58, while the suction cups 42 engage the side panel 2 as indicated in phantom lines in FIG. 1.

As is described in greater detail below, the suction cups 42 are connected with a source of vacuum pressure when located between the receiving station 36 and delivery station 44, and are disconnected from the source of vacuum pressure when located at the carton delivery station to release the carton.

Figure 7A:
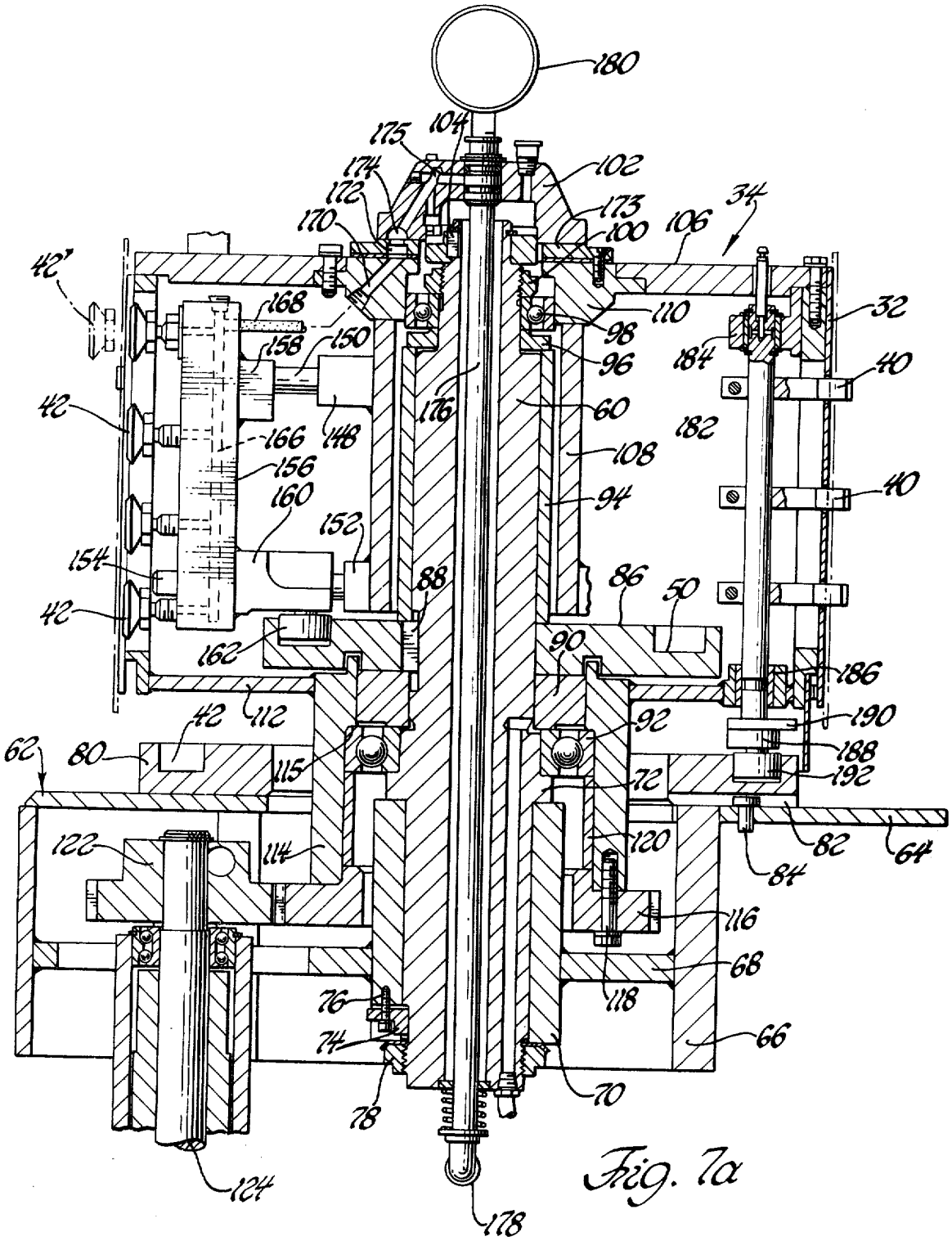

With reference to FIG. 7*a*, the drum or turret 34 is rotatably mounted on a hollow post 60 supported on a base indicated collectively by reference numeral 62. The base 62 has a top plate 64 defining an upper horizontal surface with a depending skirt member 66. A lower support plate 68 is welded to the skirt 66, and a cylindrical support sleeve 70 is mounted in an opening in the plate 68 and is secured to plate 68 by welding or other conventional means.

The hollow post 60 is formed intermediate its ends with a support flange 72 which is seated on the upper edge of the support sleeve 70. A key member 74 is secured to the support sleeve 70 by a screw 76 and projects into a slot formed in the post 60 near its lower end to secure the post against rotation with respect to sleeve 70, and hence the base 62. A nut 78 is threaded onto the lower end of the post 60 and engages the lower end of the support sleeve 70 to further secure the post in fixed relationship with the base 62.

The cam track 42 is in the form of a groove formed in a cam plate 80 seated on the upper surface of the top plate 64. The cam plate 80 is formed with a slot 82, and the head of a stud 84 mounted in the top plate of the base is received in the slot 82 to prevent rotation between the cam plate 80 and the base.

The cam track 50 is in the form of a groove formed in a cam plate 86 nonrotatably secured to the post 60 by a key 88. The cam plate 86 is seated on an annular support member 90, and the inner race of a bearing assembly 92 is received between the annular support member 90 and the flange 72 of the post.

Projecting upwardly from the cam plate 86 is a sleeve 94, and a bearing support member 96 is supported on the upper end of the sleeve 94. The inner race of the bearing assembly 98 is supported on member 96 and is secured against axial movement by a nut 100 threaded onto the post so that the bearing assembly is clamped between the nut 100 and support member 96.

Mounted on the upper end of post 60 is a valve member 102 which is secured to the post against rotation by a key 104. Valve member 102 controls communication between the suction cups 42 and the source of vacuum in a manner set forth in greater detail below.

The drum 34 has a top wall 106 from which the outer side wall 32 depends, and an inner cylindrical wall 108 depending from a central hub member 110. The hub member 110 is engaged with the outer race of the bearing assembly 98.

The drum 34 has a bottom wall 112, and a cylindrical drive sleeve 114 depends from the bottom wall 112 in coaxial realtionship wiith the post 60. The drive sleeve 114 has an inner annular shoulder 115 supported on the outer race of the bearing assembly 92. Secured to the lower end of the drive sleeve 114 by bolts 118 is a drive gear 116 for the drum. A cylindrical spacer 120 extends between the upper surface of the gear 116 and the outer race of the bearing assembly 92 to provide support for the outer race of the bearing assembly.

Figure 7B:
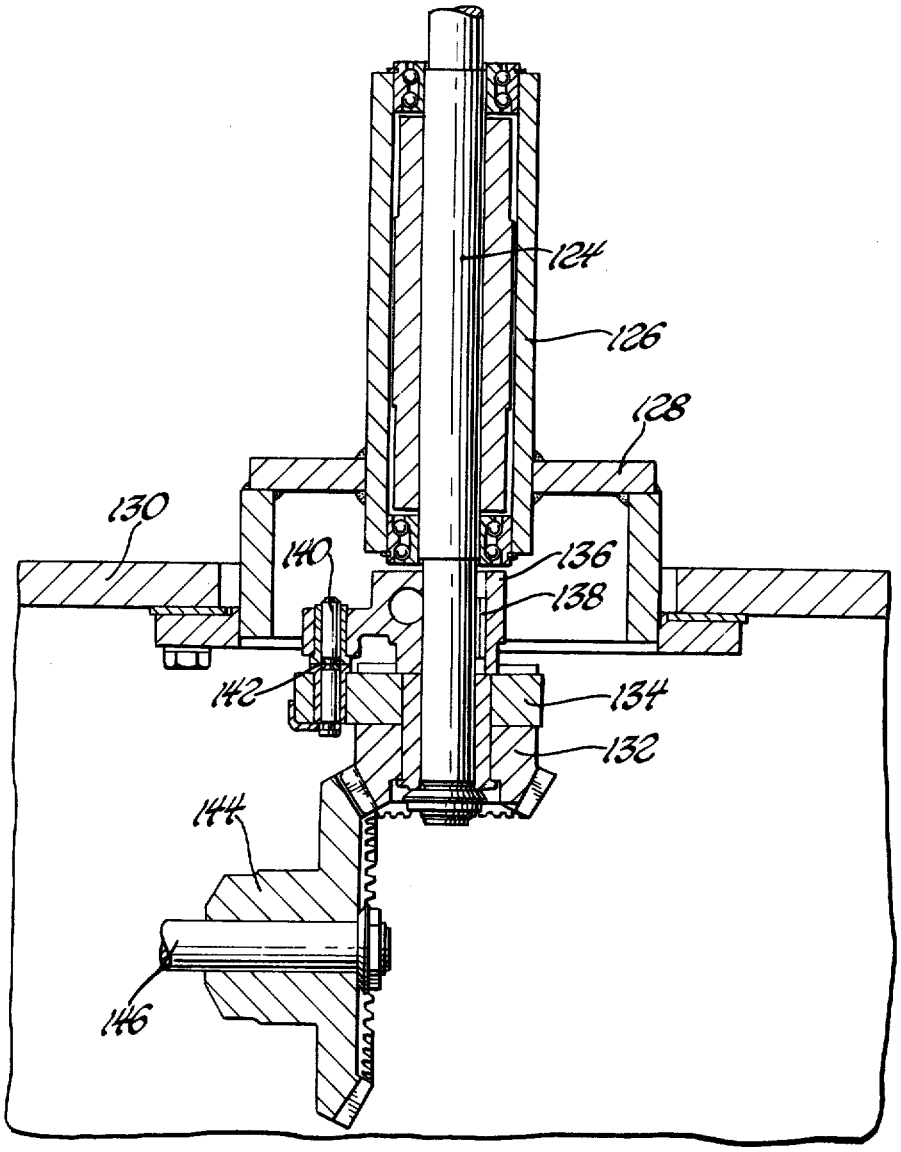

Gear 116 is engaged with an output gear 122 mounted on the upper end of a drive shaft 124. As shown in FIG. 7b, shaft 124 is rotatably supported in a sleeve 126 welded to a plate 128 secured to a support assembly 130. Mounted on the lower end of the drive shaft 124 is an input gear 132. The input gear 132 is not directly secured to the drive shaft 124, but is instead nonrotatably secured to a coupling member 134 which in turn is secured to a coupling member 136 by a shear pin 140. The coupling member 136 is nonrotatably secured to the drive shaft 124 by a key 138. Consequently, rotation of the input gear 132 is transmitted to the drive shaft 124 through the shear pin 140. Shear pin 140 has a weakened section 142 located at the interface between members 134 and 136 so that the shear pin will break in the event of overload caused, for example, by jamming of the drum mechanism, to interrupt the drive to the drum. The input gear 132 is a beveled gear, and is engaged with an output beveled gear 144 nonrotatably secured to a power shaft 146. Thus, power is transmitted to the drum from the power shaft 146 through the shear pin 140 to prevent damage to the machinery upon overload by interrupting the power to the drum upon breakage of the shear pin 140.

Formed on the inner cylindrical wall 108 of the drum 34 is a plurality of upper rod supporting members 148, and an equal number of lower rod supporting members 152. Each rod supporting member 152 is located axially beneath a rod supporting member 148. Upper and lower rods 150 and 154, respectively, are supported in the rod supporting members 148 and 152. Each pair of axially spaced rods 150 and 154 extend in parallel relationship with each other in a direction transverse to the axis of rotation 52 of the drum.

The suction cups 42 are mounted on a manifold member 156, and upper and lower slide members 158 and 160, respectively, project laterally from the manifold member 156 (FIGS. 5, *7a* and 10). The slide members 158 and 160 are formed with openings which receive the respective rods 150 and 154 to slidably support the manifold member 156 on the rods 150 and 154. In the illustrated embodiment, each manifold member supports four suction cups 42. Mounted on each of the lower slide members 160 is a cam follower roller 162 (FIGS. 5 and *7a*) which is received in the cam groove 50. Consequently, rotation of the drum about the axis 52 of the post 60 causes the manifold member 156, and hence the suction cups 42, to reciprocate in a direction transverse to the axis of rotation because of the engagement of the cam follower 162 with the cam track 50. Slots 164 are formed in the side wall 52 of the drum to permit movement of the suction cups 42 beyond the side wall 32 to the position indicated at 42' in FIG. *7a* in phantom lines.

A fluid passage 166 is formed in the manifold member 156 which communicates with each of the suction cups 42. The inlet end of the fluid passage 166 is connected with a flexible conduit 168 extending between the manifold 156 and a port 170 in the hub member 110. Port 170 communicates with a control port 172 in a control plate 173 secured by conventional screws to the hub member 110.

Formed in the valve member 102 and communicating with the control port 172 in the position shown in FIG. *7a* is a curved groove 174 which extends partway about the axis of rotation of the drum 34. The groove 174 in turn communicates through a port 175 with a conduit 176 extending through the hollow post 60. The lower end 178 of the conduit 176 is connected with a source of vacuum pressure (not shown). A pressure gauge 180 is mounted on the top of valve 102 and is in pressure communication with conduit 176. The groove 174 is arcuate and extends through an angle of slightly more than 180° about the axis of port 60. Consequently, when ports 170 and 172 communicate with the groove 174, the suction cups 42 are subjected to the vacuum pressure from conduit 176. When the ports 170 and 172 rotate to a position in which they are out of communication with groove 174, the associated suction cups 42 are subjected to a pressure other than a negative or vacuum pressure. The arcuate length of the groove 174 is such that the suction cups 142 are subjected to vacuum pressure as they engage a carton at the carton receiving station and move in a clockwise direction to position X in FIG. 3, and are subjected either to atmospheric or a positive pressure from the time the carton is released at the carton delivery station until the suction cups return to again engage a carton at the carton receiving station.

In the illustrated embodiment, there are four sets of suction cups 42 and associated manifold members 156 and support rods 150, 154, the sets each being angularly disposed 90° from each other. Consequently, there are four axially extending slots 164 in the side wall 32 of the drum located 90° apart to permit extension of the suction cups 42 located at the slots. Each manifold 156 in the illustrated embodiment supports four suction cups 42.

A set of clamping hooks 40 is associated with each set of suction cups 42, a "set" of suction cups being the suction cups mounted on each manifold member 156. Each set of clamping hooks, in the illustrated embodiment, includes three hooks 40 nonrotatably secured to a shaft 182 rotatably suspended from a lug 184 projecting from the upper, inner surface of the side wall of the drum (FIG. *7a*).

Each shaft 182 is rotatably mounted on a lug 184 and rotatably projects through the bushing 186 mounted in the bottom wall 112 of the drum. Nonrotatably secured to the lower end of the shaft 182 is a cam lever 188. Formed on each cam lever 188 is a movable carton unfolding arm 190 which, in the illustrated embodiment, engages the projecting portion 24 of panel 6 of the carton to cause the panel 6 to unfold in a counterclockwise direction, as viewed in FIG. 2, with respect to the panel 2 as the carton is carried from the carton receiving station to the carton delivery station. Rotatably mounted on lever 188 at a position spaced from the axis of shaft 182 is a cam follower roller 192 which is engaged in the cam track 42 of plate 80. The configuration of the cam track 42 with respect to the axis of rotation of the drum is such that the shaft 182, and hence the hooks 40 and cam lever 88, is caused to oscillate about the axis of shaft 182 as the drum rotates about the axis 52. The hooks 40 each project through slots 194 formed in the side wall 32 of the drum (FIG.

10). A plurality (three in the illustrated embodiment) of projections 196 (FIGS. 5 and 10) are formed on the side wall 32 adjacent each of the slots 164 to assist the clamping hooks 40 in holding the flattened cartons in position to be engaged by the suction cups 42 in the manner set forth in greater detail below.

The carton unloading means for transferring cartons one at a time from the supply container or magazine 26 to the carton receiving station is illustrated in detail primarily in FIGS. 4, 5 and 9. Meshed with the gear 116 is a pinion gear 198. The pinion gear 198 has a shaft 200 which is rotatably supported in a bearing assembly shown in FIG. 9. Projecting upwardly from the pinion gear 198 and eccentrically located with respect to the rotary axis of pinion gear 198 is a crank pin 202. A bearing assembly 204 is mounted on the crank pin 202, and one end of a crank arm 206 is mounted on the bearing assembly 204 so as to be rotatably supported on the crank pin 202. The other end of the crank arm 206 is rotatably mounted on a crank pin 208 projecting from a lever 210.

The lever 210 includes a hollow hub member 212 which rotatably receives a shaft 213. Teeth 216 depend from the lower end of hub 212, which teeth are shown in FIG. 9 as being engaged with slots in the upper end of a clutch sleeve 214. The clutch sleeve 214 is internally splined; the internal spline teeth of sleeve 214 being engaged with external spline teeth formed on the lower end of shaft 213. The clutch sleeve 214 is thus slidably and nonrotatably engaged with shaft 213.

Secured to the lower end of sleeve 214 by screws 220 is a plate 218 having depending teeth 222 which are adapted to be received in slots 224 formed in the upper end of a clutch actuating member 226. In the position of the parts as shown in FIG. 9, the slots 224 are angularly displaced from teeth 222 about the axis of shaft 213.

The clutch actuating member 226 is supported on a hydraulic cylinder 227, and is rotatable about the axis thereof. Formed in the sidewall of member 226 is slot 228, and a pin 230 projects through the slot. Pin 230 is threadedly mounted at one end in an adapted 234. The adapter 234 depends from plate 218 and is mounted on the threaded shank of a shouldered screw 235 mounted on plate 218. Thrust bearings 232 are positioned between the upper end of the adapter 234 and plate 218.

In FIG. 9, the clutch sleeve 214 is shown engaged with the lever 210. In this position, rotation of pinion gear 198 causes oscillation of lever 210, which oscillation is transmitted to shaft 213 by sleeve 214. When the actuator 226 is retracted downwardly from the position shown in FIG. 9 by the hydraulic cylinder 227, the upper end of slot 228 engages pin 230 to pull sleeve 214 out of engagement with lever 210 to interrupt the drive between lever 210 and shaft 213. The oscillatory drive to shaft 213 from lever 210 is interrupted when teeth 216 are separated axially from sleeve 214 because the rotation of pinion gear 198 and operation of crank arm 206 are not transmitted to shaft 213. The clutch assembly may also be deactivated to disengage sleeve 214 from lever 210 by rotating member 226 to a position in which slots 224 are aligned with teeth 222 whereupon the teeth 222 will be received in slots 224 to cause sleeve 214 to be displaced axially out of engagement with lever 210.

The clutch assembly 214–226 may be controlled by a safety and demand circuit from the carton closing, filling and sealing machinery to which the cartons are fed by the apparatus of this invention so that feeding of the cartons will be automatically interrupted if for any reason there is a necessity to stop carton flow into the machinery to which the cartons are transferred from the apparatus of this invention.

The assembly of the guide bars 58, carton orienting stop plate, and carton drive wheels 30 at the receiving station 36 is illustrated in detail primarily in FIG. 11. A platform 252 extends from the supply container 26 at the inlet end of the receiving station at the drive wheels 30 and beyond the outlet end of the receiving station past the point where the cartons are engaged by the suction cups 42 near the stop plate 38. As the cartons are transferred from the supply container 26 to the inlet end of the receiving station at the drive wheels 30, the lower end of the carton, which, in the illustrated embodiment, may be the end of the carton on which the projecting portion 24 of panel 6 is located (FIG. 1) is received on the platform 252.

An upstanding support frame member 254 is mounted on a bottom plate 258, and a top support plate 256 is mounted on the upper end thereof. A rod 260 has its upper end rotatably supported in the top plate 256 and its lower end rotatably supported in the bottom plate 258. Nonrotatably mounted on the upper end of the rod 260 is an actuating link 262 (see also FIGS. 4 and 6). A slot 263 is formed in the actuating link 262, and a pin 264 mounted on a lever 266 is received in the slot 263. Lever 266 is fulcrumed on a stub shaft 268 projecting upwardly from the top plate 256. As is apparent from FIGS. 4 and 6, clockwise rotation of lever 266 about the axis of the stub shaft 268 causes counterclockwise rotation of the actuating link 262, and hence the rod 260, about the axis of rod 260.

The stop plate 38 is secured to the rod 260 by conventional fasteners 269 (FIG. 11) and has slots formed therein for receiving the guide bars 58, the slots not being visible in the drawing, the slots permitting the stop plate to move transversely across the space occupied by the guide bars 58. Clockwise rotation of the actuating link 262, and hence the rod 260, causes the stop plate 38 to move to an extended position in which its end projects beyond the inner surfaces of the guide bars 58 adjacent the drum 34. Conversely, counterclockwise rotation of the link 262 and rod 260 causes the stop plate 38 to retract toward the right phantom-line position of FIG. 6 away from the drum 34.

Clockwise rotation of the lever 266 about the axis of the stub shaft 268 causes the pin 264 to rotate the actuating link 262 and rod 260 in a counterclockwise direction. Conversely, counterclockwise rotation of the lever 266 about the axis of the stub shaft 268 in turn causes clockwise rotation of the link 262 and shaft 260.

The stop plate 38 is biased to an extended position projecting to the left of the guide bars 58 as viewed in FIGS. 4 and 6 by a spring 272 mounted on a bolt 276 which in turn is mounted on a plate 274 mounted on and projecting upwardly from the top plate 256. The spring 272 engages the lever 266 on the side of the stub shaft 268 opposite link 262. The bolt 276 is slidably received in the lever 266, the spring 272 having one end seated against the lever 266 and its other end seated against a spring seat washer 273, the position of which can be adjusted by nuts 275 threaded onto the bolt 276.

The cam follower roller 270 mounted on the end of lever 266 opposite link 262 is engageable with cam plates 278 mounted on the top wall of the drum. A plurality (four in the illustrated embodiment, one for each set of suction cups and clamping hooks) of cam plates 278 are secured to the top wall of the drum by conventional fasteners 281. The cam plates 278 have salient portions 280 which, when engaged by the cam follower roller 270, causes the stop plate 38 to move to its retracted position. Thus, the stop plate 38 is normally in its extended position and is retracted each time the cam follower roller 270 on the lever 266 engages the salient 280 of a cam plate 278. The cam plates 278 are located such that the stop plate 38 is retracted each time the clamping hooks 40 engage the trailing end of a carton to clamp it against the drum to be engaged by the suction cups 42.

The drive rollers 30 are mounted on shafts supported on brackets 284 secured to the support member 254 (FIG. 11). In the illustrated embodiment, four drive wheels are provided. The drive wheels 30 are each aligned with a drive strip 286 (FIG. 10) mounted in the side wall 32 of the drum 34 so that as the drive strips pass the drive wheels, the wheels are driven by the engagement of their peripheries with the drive strips 286. Preferably, the drive wheels 30 are provided with tires of rubber or other elastomeric material, and the drive strips 286 are of rubber or similar elastomeric material to provide suitable frictional engagement on the opposite surfaces of the flattened cartons as the cartons are successively unloaded from the supply container 26 and transferred to the inlet end of the receiving station 36 to be engaged between the drive wheels 30 and the drum 34 as illustrated in FIG. 4. The rotation of the drum, coupled with the frictional engagement between the drive strips 286 on the drum and the drive wheels 30 causes the cartons to be successively propelled along the guide bars 58 and the platform 252 until the leading edge strikes the stop plate 38 which is in its extended position.

The guide bars 58 have straight portions 288 which are secured by fasteners 289 to the support member 254. Extending from the straight portions 288 of each guide bar is a curved portion 290, the end of which is adjustably mounted on an upright frame member 294 by a threaded fitting 292. The fitting 292 has a threaded shank 293 which is received in an opening in the frame member 294, and conventional nuts are threaded on the shank 293 to secure the fitting and associated guide bar to the frame member. It is apparent that by adjustment of the nuts along the length of the threaded shank portion 293, the curved portion 290 of the guide bar can be adjusted toward and away from the support frame 294. The guide bars 58 are formed with bent portions 296 at the juncture between the straight portions 288 and the curved portions 290.

The stationary carton unfolding means 46 is in the form of a curved bar or plate (FIGS. 6 and 11) having an attachment portion secured by bolts 304 to a U-shaped bracket member 300. The bracket member 300 is supported on an upright post 298 projecting from the base surface 64. The post 298 is of rectangular or other noncircular configuration, and the legs of the bracket 300 are secured by bolts 308 to a clamping member 302 so that the post 298 is enclosed completely by the bracket member 300 and clamping member 302. A thumbscrew 306 is mounted in the clamping member 302 to engage the post and securely clamp the assembly of the bracket and clamping member to the post. Holes 312 are provided along the length of the post 298 for receiving a detent pin 310 that extends through the post and the legs of the bracket member 300 to make it possible to position the bracket 300 at selected positions along the length of the post to accommodate different size cartons. As the cartons move past the carton unfolding member 46, portion 20 of panel 8 of the carton is engaged by the curved bar 46 on the surface thereof opposite the drum so that movement of portion 20 of the carton along the rear surface of the curved bar causes unfolding movement of the carton.

As the carton moves out of engagement with the stationary carton unfolding means 46, its leading edge at the junction between panels 4 and 8 of the carton strikes the stationary member 48 which operates to complete the unfolding operation by first causing the carton to assume its rectangular configuration and then causing the panels 4, 6 and 8 to move "over-center" or toward a collapsed or flattened condition, with panels 2 and 4 opposite each other, and panels 6 and 8 opposite each other, or in the opposite direction from the original flattened condition so that when the carton is disengaged from the member 48, it will spring back into a substantially rectangular configuration.

The stationary member 48 (FIGS. 4, 6 and 8) includes a base plate 314 secured to the top plate 64 of the base 62 and an upright frame member 316 of T-shaped cross-section with the bar 317 of the T-section being tapered upwardly as shown in FIG. 8.

Mounted on frame member 316 is an angle plate 322, one leg 321 of which is secured to the frame member 316. Secured to the other leg of the angle frame 322 is a support plate 318 for a bearing assembly (not shown) for a roller 320, the periperhy of which projects beyond the periphery of the angle frame 322 toward the axis of the drum 34.

The operation of the apparatus will be described primarily in connection with FIGS. 4 and 6 with occasional reference to other FIGURES for specific features. In FIG. 6, one set of suction cups 42 and its associated set of clamping hooks 40 are shown in phantom lines in a plurality of sequential positions as they move through the carton receiving station past the stationary carton unfolding member 48, each successive position being indicated by the subscript letters *a–j* respectively, following the reference numerals of the parts, and being referred to below as positions *a* through *j*, respectively.

With reference to FIG. 4, as the shuttle member 244 moves from its retracted position shown in phantom lines in FIG. 4 to its extended position shown in full lines in FIG. 4 on a feed stroke, the trailing edge of the carton C at the end of the container or magazine 26 is engaged by the shuttle member and transferred out of the container until the leading end of the carton is received between the wheels 30 and the strips 286 (FIG. 10) mounted in the side wall of the drum 34. The rotation of the drum clockwise in FIG. 4 causes the carton to be driven between the drum and the periphery of the friction wheel 30 along the straight portions of the guide bars 58 toward the stop plate 38. At this point, the stop plate 38 is in its extended position, and the leading edge of the carton engages the stop plate to momentarily stop the motion of the carton along the platform 252. Thus, the shuttle member 244 transfers the cartons from the container C to the inlet end of the carton receiving station, the inlet end of the carton receiving station being defined at the right end of platform 252 in FIG. 11, or at the position where the drum and friction wheels 30 engage the carton. The platform 252, for purposes of description, may be considered to extend from the inlet end of the receiving station 36 to the outlet end thereof.

As the leading edge of the carton strikes the stop plate 38, the clamping hooks are located at approximately position 40*a* (FIG. 6) and trail the trailing edge of the carton. The configuration of the cam track 48 is such that the hooks at position 40*a* are in a retracted position but are moving toward a carton clamping position. In position *a*, the suction cups 42*a* of FIG. 6 are moving outwardly toward the guide bars 58 because of the configuration of cam track 50, and in position 42*a*, are disconnected from the source of vacuum pressure.

As the suction cups and hooks move from position *a* indicated by reference numerals 42*a* and 40*a*, respectively, to position *b*, indicated by reference numerals 42*b* and 40*b*, respectively, the cam plate 278 has moved past the roller 270 on the lever 266 to cause momentary retraction of the stop plate 38. As the stop plate is retracted, the hooks 40 engage the trailing edge of the carton, and as indicated at position 40*b*, the hooks have begun a clockwise motion with respect to the side wall of the drum to move the carton toward the side wall of the drum. As the suction cups and hooks move from position *a* to position *b*, the following sequence of actions take place: (1) the leading edge of the carton engages the stop plate to orient the trailing edge of the carton to be engaged by the hooks 40, (2) the roller 270 on lever 266 is engaged by the cam plate 278 and retracts the stop plate 38 as it passes over the salient 280 of the cam plate 278 to release the carton, (3) the hooks 40 engage the trailing edge of the carton and begin clockwise movement from their retracted position toward a clamping position to move the carton toward the side wall of the drum, and (4) the suction cups 42 continue their outward movement with respect to the rotary axis of the drum.

In position *c*, the hooks 40*c* are substantially in the fully clamped position and have moved the carton C tightly against the side wall of the drum and the projections 196 adjacent the slot 164, with the panel 2 of the carton (FIG. 1) overlying slot 164 and aligned with the suction cups 42. Suction cups 42*c* have moved outwardly of the slot 164 into engagement with panel 2, and have come into communication with the source of vacuum pressure to engage panel 2 and hold the carton by means of the suction.

As the suction cups and hooks move from the position *c* to position *d*, the leading edge of the carton slides along the curved portion 290 of the guide bars 58, and the hooks 40 begin a counterclockwise movement about the axis of the hook shaft 182 to retract away from the carton now held by the suction cups 42*d*. The counterclockwise movement of the hooks 40*d* is also accompanied by counterclockwise rotation of the carton unfolding arm 190 on the lever 88, and the arm 190 moves outwardly toward engagement with the portion 24 of panel 6 of the carton that projects beyond the edge 22 of panel 2.

As the arm 190 moves from position *d* to position *e*, it engages the projecting portion 24 and causes unfolding movement of the carton by pivoting panel 6 counterclockwise with respect to panel 2. Simultaneously, the upper projecting portion 20 of panel 8 engages the surface of the unfolding bar 46 (see also FIG. 11), and the suction cups begin a retracting movement inwardly toward the axis of rotation of the drum.

In the position of the suction cups, hooks and unfolding arm indicated at 42*f*, 40*f* and 190*f*, respectively, the arm 190 is almost fully extended, the suction cups 42*f* have further retracted toward the axis of the drum, and the projecting portion 20 of panel 8 of the carton is still slidably engaged with the surface of the stationary unfolding arm 46 that is opposite the suction cups to cooperate with the arm 190 to continue the unfolding movement of the carton.

In position *g* of the parts indicated by reference numerals 40*g*, 42*g* and 190*g*, the leading edge of the carton at the junction between the panels 4 and 8 has engaged the stationary unfolding member 38 as shown in FIG. 6 with the suction cups 42 continuing to move in a clockwise direction. This movement results in the carton assuming the rectangular configuration at position *h* with the parts at 42*h* and 40*h*. The engagement of the carton with the stationary member 48 momentarily stops the movement of the leading edge of the carton and the continued movement of panel 2 because of its engagement with the suction cups 42 causes the carton to unfold to the rectangular position indicated at position *h*. In this position, the hooks 40*h* have retracted completely out of engagement with the carton and portions 20 and 24 of the carton have separated from the bar 46 and arm 190, respectively.

As the suction cup continues its clockwise movement to position 42*i*, the carton is stripped past the stationary member 48, and the panels 4, 6 and 8 move overcenter toward a flattened condition in the opposite direction from the original flattened condition in which the panels 4 and 8 are disposed opposite to each other.

As the carton moves past the stationary member 48, the panels 4 and 8 are guided past the stationary member 48 by the roller 320, and when the carton is completely disengaged from roller 320, it springs back to a substantially rectangular configuration because of the natural resiliency of the material at the scored lines 14.

When the carton reaches position X (FIGS. 3 and 4), the panel 2 engages the surface of the transfer guide bar 54 opposite the drum, the suction cups become disconnected with the vacuum pressure to release the unfolded carton, and panel 8 is engaged by the transfer suction cups 56 at the delivery station.

In the illustrated embodiment, as shown in FIG. 4, groove 174 of valve 102 extends approximately 210° about the rotary axis of the drum. The specific angle of 210° is given by way of example only, and is not to be considered a limitation of the invention. As pointed out above, the passages 166 of the suction cup manifolds 156 are connected with vacuum pressure when they are in communication with groove 174. As the suction cups move past the left hand end of groove 174, as viewed in FIG. 4, the carton C carried thereby moves into engagement with guide bar 54, and the suction cups are disconnected from vacuum pressure. As the carton moves into engagement with the guide bar 54, the suction cups are connected either with atmospheric pressure, or a pressure above atmospheric pressure by valve 102 to cause the cups 42 to release the carton. The valve 102 thus conditions the suction cups, or carton carrying means, to retain a carton engaged by the suction cups at the receiving station, and conditions the suction cups to release the carton at the delivery station.

While a specific form of the invention is illustrated in the accompanying drawings and described in the foregoing specification, it should be understood that the invention is not limited to the exact construction shown. To the contrary, various alterations in the construction and arrangement of parts, all falling within the scope and spirit of the invention, will be apparent to those skilled in the art.

The embodiments of the invention in which an exclusive property or privilege is claimed are defined as follows:

1. Carton feeding and erecting apparatus for transferring flattened cartons from one location to another while simultaneously unfolding the cartons to an erect condition, said apparatus comprising: means defining a carton receiving station at one location; means defining a carton delivery station at another location; carton carrying means operable to engage a flattened carton at the receiving station and carry the carton to the delivery station; carton unfolding means operatively associated with said carrying means operable to unfold a carton to its erect condition as the carton is carried by the carrying means from the receiving station to the delivery station; clamping means having a clamping position in which it is operable to engage a flattened carton at said receiving station and hold it in a position to be engaged by said carrying means to be carried from the receiving station to the delivery station, said clamping means being operable to move out of engagement with a carton engaged by said carrying means to a retracted position as the carton moves from the receiving station to the delivery station; said receiving station extending from an inlet end thereof to an outlet end thereof, said outlet end being locating nearest the delivery station in the direction of travel of a carton to said delivery station, said clamping means and carrying means being operable to sequentially engage a carton when the carton is located between the inlet and outlet ends of said receiving station; a supply container for containing a plurality of flattened cartons; unloading means operable to transfer cartons one at a time from said supply container to the inlet end of said receiving station; carton driving means for moving a carton from the inlet end of said receiving station to a position to be engaged by said clamping means; and, carton orienting means operable to engage and orient a carton being moved by said driving means in a position to be engaged by said clamping means.

2. Apparatus as claimed in claim 1 including a rotatable drum having a top wall and a peripheral side wall depending therefrom.

3. Apparatus as claimed in claim 2 further including clamping means having a clamping position in which it is operable to engage a flattened carton at said receiving station and hold it in a position to be engaged by said carrying means to be carried from the receiving station to the delivery station.

4. Apparatus as claimed in claim 3 wherein said clamping means is operable to move out of engagement with a carton engaged by said carrying means to a retracted position as the carton moves from the receiving station to the delivery station.

5. Apparatus as claimed in claim 4 wherein said clamping means is mounted on said drum such that rotation of said drum causes said clamping means to move between its clamping and retracted positions.

6. Apparatus as claimed in claim 5 wherein said clamping means includes a rod carried by said drum and extending parallel to the axis of rotation of said drum, and at least one hook mounted on said rod and projecting transversely therefrom.

7. Apparatus as claimed in claim 6 including cam means interconnected between said drum and rod to cause said rod to oscillate about its longitudinal axis during rotation of said drum to cause said hook to move between the clamping and retracted positions.

8. Apparatus as claimed in claim 7 wherein said cam means comprises an endless clamping means cam track enclosing the axis of rotation of said drum, a cam lever fixed to said rod, and a cam follower carried by said cam lever and engaged with said carrying means cam track, said follower being spaced from the longitudinal axis of said rod.

9. Apparatus as claimed in claim 8 wherein said cam lever is formed with a carton unfolding arm movable during rotation of said drum between a retracted position out of engagement with a carton carried by said carrying means and an extended position in which it is operable to engage a portion of a carton carried by said carrying means and cause unfolding movement of such carton.

10. Apparatus as claimed in claim 1 wherein said orienting means is operable to move into and out of the path of cartons being moved by said drive means in timed sequence with said unloading means, clamping means and carrying means.

11. Apparatus as claimed in claim 1 wherein said carton unfolding means includes stationary unfolding means engageable by a carton traveling between said receiving station and delivery station and located with respect to the path of movement of said carrying means such that engagement of said stationary unfolding means by a carton on said carrying means causes unfolding movement of such carton.

12. Apparatus as claimed in claim 11 wherein said carton unfolding means further includes movable unfolding means movable with said carrying means from said receiving station to said delivery station, said movable unfolding means being movable between a retracted position out of engagement with a carton carried by said carrying means and an extended position in which it engages a portion of a carton carried by said carrying means and causes unfolding movement of such carton.

13. Apparatus as claimed in claim 10 wherein said carton unfolding means further includes movable unfolding means movable with said carrying means from said receiving station to said delivery station, said movable unfolding means being movable between a retracted position out of engagement with a carton carried by said carrying means and an extended position in which it engages a portion of a carton carried by said carrying means and causes unfolding movement of such carton.

14. Apparatus as claimed in claim 13 further including a drive train connected with a power source for causing operation of said unloading means, carton driving means, orienting means, clamping means, carrying means and movable carton unfolding means in timed sequence with each other.

15. Apparatus as claimed in claim 1 including a powered rotatable drum having a top wall and a peripheral side wall depending therefrom, and at least one rotatable friction wheel engaged with said side wall at the inlet end of said receiving station, said drum and friction wheel constituting said carton driving means.

16. Apparatus as claimed in claim 1 further including conditioning means connected with said carrying means operable to condition said carrying means to retain a carton engaged at said receiving station and to condition the carrying means to release the carton at the delivery station.

17. Apparatus as claimed in claim 2 wherein said carrying means is mounted on said drum such that rotation of said drum causes said carrying means to cyclically move past said receiving and delivery stations.

18. Apparatus as claimed in claim 17 further including means for causing reciprocation of said carrying means in a direction normal to the axis of rotation of said drum during rotation of said drum.

19. Apparatus as claimed in claim 18 wherein said last named means comprises cam means interconnected between said drum and carrying means.

20. Apparatus as claimed in claim 19 including at least one rod mounted on said drum and extending in a direction normal to the axis of rotation of said drum, said carrying means being slidably mounted on said rod, and said cam means causing said carrying means to reciprocate on said rod during rotation of said drum.

21. Apparatus as claimed in claim 18 wherein said cam means comprises an endless carrying means cam track enclosing the axis of rotation of said drum, and a cam follower carried by said carrying means and engaged with said cam track.

22. Apparatus as claimed in claim 21 wherein said carrying means includes at least one suction cup engageable with the surface of a carton.

23. Apparatus as claimed in claim 22 further including a valve for controlling communication between said suction cup and a source of vacuum pressure, said valve being operable to connect said suction cup with vacuum pressure when the suction cup engages a carton at the receiving station and being operable to disconnect said suction cup from the vacuum pressure when the suction cup is at the delivery station.

24. Apparatus as claimed in claim 16 wherein said carrying means includes at least one suction cup, and further including a source of vacuum pressure, said conditioning means comprising a valve operable to connect said suction cup with said source of vacuum pressure when said suction cup engages a carton at said receiving station, and to disconnect said suction cup from said source of vacuum pressure when said cup is at said delivery station.

25. Carton feeding and erecting apparatus for transferring flattened cartons from one location to another while simultaneously unfolding the cartons to an erect condition; said apparatus comprising; means defining a carton receiving station at one location; means defining a carton delivery station at another location; a supply container for containing a plurality of flattened cartons; a support; a drum rotatably mounted on said support; carton unloading means operable to successively transfer cartons from said supply container to said receiving station; carton carrying means on said drum operable during rotation of said drum to engage a carton at the receiving station and transfer the carton to the delivery station; carton unfolding means operatively associated with said carrying means operable to unfold the carton to its erect condition as it is transferred to the delivery station from the receiving station; clamping means having a clamping position in which it is operable to engage a flattened carton at said receiving station and hold it in a position to be engaged by said carrying means to be carried from the receiving station to the delivery station; carton driving means for moving a flattened carton to said receiving station, and carton orienting means operable to engage and orient a carton being moved by said driving means in a position to be engaged by said clamping means.

26. Apparatus as claimed in claim 25 wherein said carton receiving station has an inlet end and an outlet end and further including stationary guide bars extending along the length of said receiving station and spaced from the periphery of said drum; said orienting means comprising a stop plate between the inlet and outlet ends of said receiving station and having an extended position projecting into the space between said guide bars and drum and a retracted position in which it is withdrawn from said space.

27. Apparatus as claimed in claim 26 further including actuating means for said plate operable to move said stop plate between its extended and retracted positions; and biasing means biasing said actuating means to hold the stop plate in its extended position.

28. Apparatus as claimed in claim 27 further including cam means in said drum engageable with said actuating means during rotation of said drum for causing said actuating means to intermittently actuate said stop plate to its retracted position.

29. Apparatus as claimed in claim 28 further including stationary unfolding means mounted on said support means.

30. Apparatus as claimed in claim 29 wherein said stationary carton unfolding means comprises a curved plate engageable by a portion of a carton carried by the carrying means during rotation of the drum and operable to cause unfolding movement of the carton.

31. Apparatus as claimed in claim 30 wherein said stationary carton unfolding means further comprises an abutment member engageable by the leading edge of a carton carried by the carrying means as the carton is carried past said curved plate during rotation of the drum, the engagement of the carton with said abutment causing the carton to unfold as the drum continues to rotate.

32. Carton feeding and erecting apparatus for transferring flattened cartons from one location to another while simultaneously unfolding the cartons to an erect condition; said apparatus comprising: a support means; a drum rotatably mounted on said support means; suction cup carton carrying means mounted on said drum for reciprocating movement in a direction transverse to the rotary axis of said drum; a first cam surface fixed to said support means and enclosing the rotary axis of said drum; a cam follower carried by said carton carrying means and engaged with said first cam surface for causing reciprocation of said carton carrying means during rotation of said drum; a shaft rotatably mounted on said drum in radially spaced, parallel relationship with the rotary axis of said drum; a lever nonrotatably mounted on said shaft; a carton unfolding arm on said lever movable between extend and retracted positions in response to oscillation of said lever about the axis of said shaft; clamping means mounted on said shaft and movable in response to oscillation of said shaft between a clamping position to clamp a carton against said drum to be engaged by the suction cup carrying means and a retracted position spaced from the carton; a second cam surface fixed to said support means and enclosing the rotary axis of said drum; and a cam follower on said lever engaged with said second cam surface, said last named cam follower being spaced from the axis of said shaft to cause oscillation of said lever about the axis of said shaft in response to rotation of said drum to cause said carton unfolding arm to unfold a carton carried by said carton carrying means from a flattened condition during rotation of said drum and reciprocation of said carton carrying means.

* * * * *